US006788172B1

(12) United States Patent
Godesa et al.

(10) Patent No.: US 6,788,172 B1
(45) Date of Patent: Sep. 7, 2004

(54) DEVICE FOR CONTROLLING THE CLOSING OF A POWER CIRCUIT BREAKER

(75) Inventors: Ludvik Godesa, Berlin (DE); Marc Liebetruth, Glienicke (DE)

(73) Assignee: Siemens Aktiengesellschaft, Munich (DE)

( * ) Notice: Subject to any disclaimer, the term of this patent is extended or adjusted under 35 U.S.C. 154(b) by 105 days.

(21) Appl. No.: 10/130,748

(22) PCT Filed: Nov. 22, 2000

(86) PCT No.: PCT/DE00/04203

§ 371 (c)(1),
(2), (4) Date: May 23, 2002

(87) PCT Pub. No.: WO01/39223

PCT Pub. Date: May 31, 2001

(30) Foreign Application Priority Data

Nov. 24, 1999 (DE) ..... 199 57 391

(51) Int. Cl.[7] ..... H01H 73/12
(52) U.S. Cl. ..... 335/17; 200/400; 200/308
(58) Field of Search ..... 335/17, 165–176, 335/16; 200/400–401, 500–501, 308, 318, 323–325

(56) References Cited

U.S. PATENT DOCUMENTS 6,144,002 A 11/2000 Coudert et al.

FOREIGN PATENT DOCUMENTS

DE 43 33 828 C1 3/1995

*Primary Examiner*—Lincoln Donovan
(74) *Attorney, Agent, or Firm*—Harness, Dickey & Pierce, P.L.C.

(57) ABSTRACT

A device is for controlling the closing of a power circuit breaker according to operational parameters. The device includes an indication element for indicating the readiness for closing and a coupling element which interacts with the indication element. The operational parameters, for example, energy store empty or switchgear cell door open cause the indication element to pivot into the position not ready for closing and cause the coupling element to move into its disabled position. The indication element for indicating the readiness for closing and additional indication elements, which represent the position of the switching contacts and the state of the energy store, are adjacently arranged in an axial manner such that they can pivot and are provided with interacting drives in order to effect a forced drive of the indication element for indicating the readiness for closing when the position of the switching contacts or the state of the energy store does not enable or permit a closing of the power circuit breaker.

28 Claims, 2 Drawing Sheets

DEVICE FOR CONTROLLING THE CLOSING OF A POWER CIRCUIT BREAKER

This application is the national phase under 35 U.S.C. § 371 of PCT International Application No. PCT/DE00/04203 which has an International filing date of Nov. 22, 2000, which designated the United States of America, and which claims priority on German Application number DE 19957391.3 filed Nov. 24, 1999, the entire contents of which are hereby incorporated by reference.

FIELD OF THE INVENTION

The invention generally relates to a device for controlling the closing of a power circuit breaker according to operational parameters. Preferably, it relates to a power circuit breaker including switching contacts, an energy store for transferring the switching contacts from an opening position into a closing position, a latching device for maintaining a tensioned state of the energy store and at least one closing actuator for releasing the latching device and enabling the energy store. Arranged in the path of the force transfer from the closing actuator to the latching device, may be a coupling element, which can be moved into an active position and an inactive position. Each of the parameters may cause the coupling element to be transferred into the inactive position, in which the force transfer from the closing actuator to the latching device is interrupted. An indicating element, which is dependent on the coupling element and can be moved into two positions corresponding to the states, may be provided for visually presenting the states of "ready for closing" and "not ready for closing"

BACKGROUND OF THE INVENTION

A device for controlling a power circuit breaker is disclosed by DE 43 33 828 C1. It makes it possible for a user of the power circuit breaker to verify that the power circuit breaker can be closed by viewing the separate indicating element.

At the same time, the device prevents the energy store from being enabled in spite of activation of a closing actuator, such as a manually operated pushbutton or electromagnet, if one of the conditions is not satisfied. Since all the features or parameters which oppose closing of the power circuit breaker can be considered, the device makes an important contribution to the safety of the users of power circuit breakers and to the protection of electrical switchgear.

SUMMARY OF THE INVENTION

An embodiment of the invention is based on an object of providing a device which has a simplified construction and smaller dimensions. As a result, such a device may make it possible to use the advantages of the indication of closing readiness for all power circuit breakers which have a stored-energy mechanism.

The stated object is achieved according to an embodiment of the invention by at least one of the following further features:

- the indicating element for closing readiness has working surfaces which can be acted on by the operational parameters and is able to be transferred by each of the parameters, counter to the action of a restoring force, from the "ready for closing" position into the; "not ready for closing" position,
- the indicating element and the coupling element have interacting working surfaces for transferring the coupling element into its inactive position when the indicating element assumes the "not ready for closing" position.

Consequently, the indicating element for closing readiness additionally has the logical OR function for the operational parameters. This has an advantageous effect on the space requirement of the device.

Within the scope of an embodiment of the invention, the indicating element for closing readiness can be moved about a pivot axis, the coupling element, which is designed in the manner of a lever, can be displaced in its longitudinal direction by the closing actuator and has a frame-like middle part, reaching over a fixed guiding surface with a clearance and being able to be transferred by two drivers of the indicating element into the active position or the inactive position. This likewise has the effect of saving unit volume.

In connection with the design explained above of the indicating element for closing readiness, the fixed guiding surface may be formed by an attachment which is arranged concentrically in relation to the pivot axis of the indicating element and against which one frame leg of the middle part of the coupling element bears in its active position, and if the drivers of the indicating element for closing readiness reach over the other frame leg of the middle part. This has the effect that the coupling element is taken up and guided in such a way that, on the one hand, it can be displaced in its longitudinal direction by a closing actuator and, on the other hand, it can be pivoted under the influence of the: indicating element to assume the active or inactive position.

In the case of power circuit breakers, it is also possible in connection with an embodiment of the invention for an indicating element representing the state of the energy store and a further indicating element, representing the position of the switching contacts, to be provided in addition to the indicating element for closing readiness. Within the scope of an embodiment of the invention, it can be provided that said additional indicating elements are likewise arranged such that they can be moved about the pivot axis of the indicating element for closing readiness and that the additional indicating elements each have a driver for driving the indicating element for closing readiness. This achieves, in a particularly simple and therefore space-saving way, the effect that two of the conditions for closing readiness of the power circuit breaker, that is "switching contacts open" and "energy store tensioned", become effective directly, without relying on mechanical devices.

It can contribute to a compact type of construction of the device and at the same time to a reliable function that the closing latching lever bears a lug for direct forcible actuation of the indicating element for the state of the energy store in both positions ("tensioned" and "empty") and for actuating the indicating element for closing readiness only in the "not ready for closing" direction.

In this case it proves to be expedient to arrange the indicating element for closing readiness centrally between the indicating elements for the switching position and for the state of the energy store, thereby creating a mechanically compact arrangement which allows the user an overview and makes it possible to see the state of the power circuit breaker at a glance.

Depending on the conditions at the place where a power circuit breaker is installed, there may be a different number of mechanical parameters to be supplied to the device according to an embodiment of the invention, as explained in the aforementioned DE 43 33 828 C1. In this case, it may prove to be advantageous to provide for the supplying of parameters based on the state of actuating magnets an intermediate shaft which has a first lever arm, interacting with the indicating element for closing readiness, and a second lever arm, interacting with a latching device controlling the opening of the power circuit breaker. This intermediate shaft allows, on the one hand, a separation of the parameters existing in the power circuit breaker itself from those which originate outside the power circuit breaker, for example "door of the switchgear cell open" or "power circuit breaker drawn out". In addition, the intermediate shaft makes possible a desired mechanical transmission ratio for adapting the stroke and force of actuating magnets to the device according to an embodiment of the invention and a desired spatial position in relation to the indicating element for closing readiness and the coupling element.

The intermediate shaft also offers the possibility of assigning an opening actuator to the device. This can take place by the intermediate shaft bearing as a third lever arm an opening lever arm, which can be acted on by an opening actuator. This can take place directly or with an auxiliary lever interposed, if the spatial position of the element to be coupled makes this appear to be necessary.

BRIEF DESCRIPTION OF THE DRAWINGS

The invention is explained in more detail below on the basis of the exemplary embodiment represented in the figures.

Figure 1:
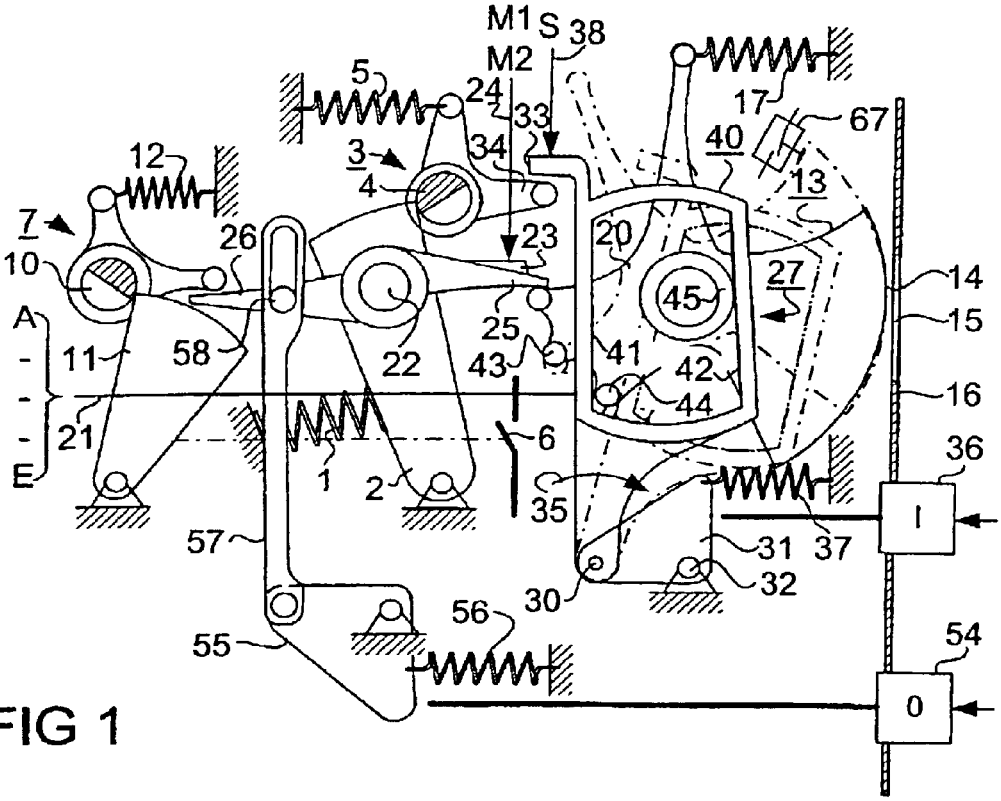
FIG. 1 shows a device for controlling the closing readiness of a low-voltage power circuit breaker, some components of the power circuit breaker being represented in a schematically simplified form.
Figure 2:
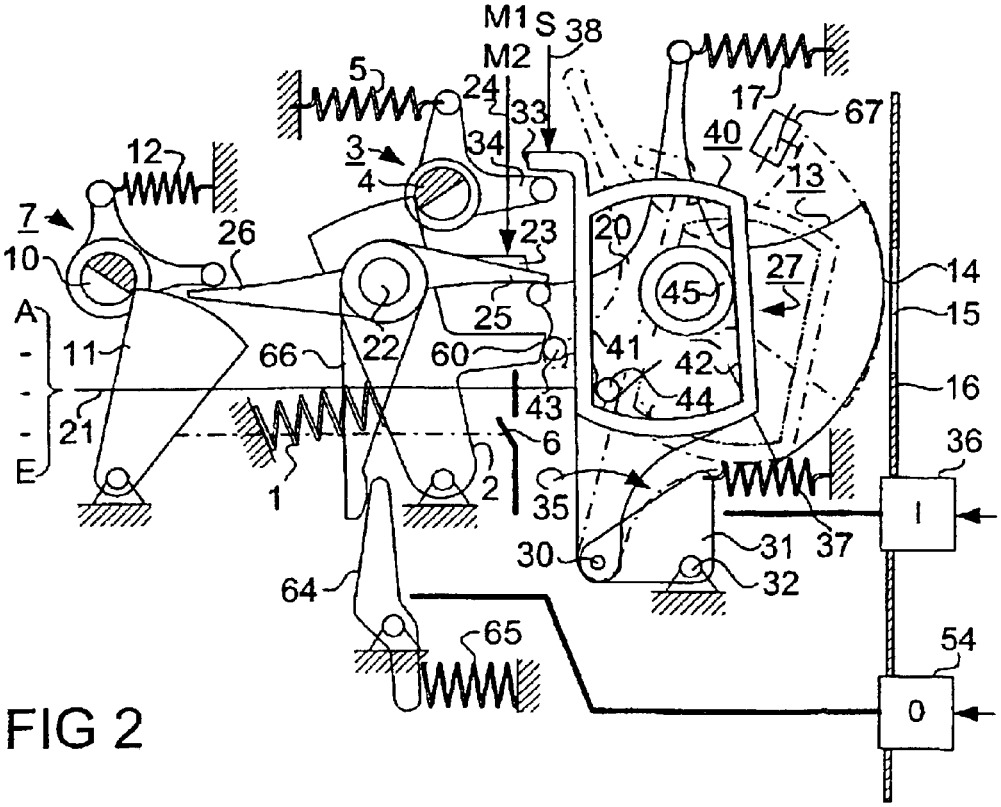

A modified exemplary embodiment of a device for controlling closing readiness is shown in FIG. 2 in a representation corresponding to FIG. 1.

In FIGS. 3, 4, 5 and 6, a group of indicating elements are shown separately in different operating states as a component part of the device according to FIG. 1.

DETAILED DESCRIPTION OF THE PREFERRED EMBODIMENTS

Shown in FIG. 1, as a component part of a low-voltage power circuit breaker, is an energy store 1 in the form of a compression spring, which can be transferred into a tensioned state in a known way by use of a closing latching lever 2 and is kept in the tensioned state by a latching device 3. The latching device 3 includes a rotatably mounted closing half-shaft 4, which interacts with a pivotably mounted closing latching lever 2. The closing half-shaft 4 of the latching device 3 is pretensioned into the position shown by a tension spring 5, whereby the energy store 1 is kept in the charged state. A clockwise rotation of the closing half-shaft 4 causes sliding off of the latching surface on the closing latching lever 2 and, as a result, enabling of the energy store I to close the indicated switching contact 6.

A further latching device 7 is constructed in a way similar to the latching device 3 and accordingly has an opening half-shaft 10 and an opening latching lever 11. If the opening half-shaft 10 is rotated out of its position of rest, counter to the action of a tension spring 12, the opening latching lever 11 slides off the opening half-shaft 10 and causes in a known way the opening of the switching contact 6. The mechanical connections between the opening latching lever 11 and the switching contact 6 have been omitted to simplify the representation, since they are not required for understanding the invention and can be the same or similar to those of known power circuit breakers.

The device to be described in more detail below, according to FIG. 1, serves the purpose of making it possible to enable the closing latching lever 2 to close the switching contact 6 only if all the conditions to allow closing to be carried out are satisfied and closing is permissible from the aspect of user safety and technical reliability. A series of parameters which are of significance in this context are described in DE 43 33 828 C1, mentioned at the beginning. Named there as examples of operational parameters are:

A position of the operating shaft,

B removal of the overcurrent trip from the power circuit breaker,

C blocking with respect to further power circuit breakers of a switchgear,

D position of the door of a switchgear cell accommodating the power circuit breaker, E position of the power circuit breaker in the slide-in frame and the state of the actuating magnets M1, M2 and S.

All the named parameters are brought together in the case of the device shown by a pivotably mounted indicating element 13 for closing readiness, which has an indicating surface 14 for the visual presentation of indicating readiness in a window 15 of an operating face 16 of the power circuit breaker. A tension spring 17 pretensions the indicating element 13 into the position shown, which corresponds to the position of existing closing readiness. An extension arm 20, opposite from the indicating surface 14, serves for introducing mechanical movements which correspond to the stated operational parameters of the power circuit breaker. In this respect, the supplying of the parameters A to E is represented in FIG. 1 by an arrow 21 directed at the extension arm 20. As can be seen, each of these parameters causes pivoting of the indicating element 13, counter to the action of the restoring spring 17, and consequently counter-clockwise into the position indicated by dot-dashed lines, by which absent closing readiness is indicated in the viewing window 15.

The same effect, that is to say the "not ready for closing" indication, is brought about by an intermediate shaft 22, on which there is arranged a lever arm 23 for introducing the parameters-M1 and M2 in the direction of an arrow 24 and a further lever arm 25 for acting on the extension arm 20. A further lever arm 26, arranged opposite from the lever arms 23 and 25 of the intermediate shaft 22, interacts with the opening half-shaft 10. In this way, the parameters M1 and M2 at the same time cause the desired opening of the switching contact 6 and the "not ready for closing" indication of the indicating element 13.

Interacting with the indicating element 13 for closing readiness is a coupling element 27, which is designed overall in the manner of a lever and is arranged movably at its lower end about a pivot bearing 30. The pivot bearing 30 is not fixed, but movable on a tilting lever 31 with a fixed pivot bearing 32. At its end opposite from the pivot bearing 30, the coupling element 27 reaches with a working surface 33, designed in the manner of a hook, over a lever arm 34 mounted on the closing half-shaft 4. If the coupling element 27 is pivoted clockwise about the pivot bearing 30 in the direction of an arrow 35, the working surface 33 disengages from the lever arm 34. In this case, all the movements acting on the coupling element 27 in the longitudinal direction of the latter which are exerted by closing actuators remain without effect on the closing half-shaft 4. In the example shown, closing actuators 36 and S (arrow 26) arc shown. The closing actuator 36 is formed by a closing pushbutton, which is located on the operator console 16 of the power circuit breaker, can be operated manually and acts on the aforementioned tilting lever 31. As a result, the tilting lever 31 is pivoted counterclockwise, counter to the action of a restoring spring 37, about its pivot bearing 32 and, as a result, the pivot bearing 30 of the coupling element 27 is displaced downward. If the working surface 33 is in this case in the effective range of the lever arm 34, the closing half-shaft 4 is driven along with it. The same happens if the further closing actuator S, formed by a call-up magnet, acts on the coupling element 27 in the direction of the arrow 38.

As already mentioned, the closing actuators 36 and S remain without effect if the coupling element 27 is pivoted clockwise and, as a result, the working surface 33 is moved away from the lever arm 34. To cause this movement, the coupling element 27 has a middle part 40, formed in the manner of a frame, which has two frame legs 41 and 42 extending approximately parallel and in the longitudinal direction of the coupling element 27. Of these, the frame leg 41 is reached over, somewhat in the manner of a fork, by two drivers 43 and 44 located on the extension arm 20 of the indicating element 13, while the further frame leg 42 bears against a concentric attachment 45 of the indicating element 13 in the state of rest of the coupling element 27.

The position of the drivers 43 and 44 between the pivot bearing 30 and the working; surface 33 of the coupling element 37 achieves the effect that the described pivoting of the indicating element 13 counterclockwise into its "not ready for closing" position moves the coupling element clockwise about its pivot bearing 30 and, as a result, disengages the working surface 33 from the lever arm 34 of the closing half-shaft 4. Conversely, the coupling element 27 is returned to the position shown by solid lines in FIG. 1 as soon as the indicating element 13 returns to its "ready for closing" position.

The power circuit breaker considered in connection with the invention has in addition to the indicating element 13 for closing readiness two further indicating elements 46 and 47, which visually illustrate to a user the switching state of the switching contact 6 or the state of the energy store 1. According to FIGS. 3, 4, 5 and 6, said three indicating elements 13, 46 and 47 are arranged adjacently, the additional indicating elements 46 and 47 being pivotable in the same way as the indicating element 13 about said pivot axis. The additional indicating elements 46 and 47, arranged on either side of the indicating element 13 for closing readiness, each have a driver 50 and 51, respectively, extending axially in the direction of the indicating element 13 in the middle. Interacting with these drivers 50 and 51 are drivers 52 and 53, likewise extending axially from the indicating element 13 to both sides. This achieves the effect of forcibly driving the indicating element 13 for closing readiness into the "not ready for closing" position if the switching contacts are not opened or if the energy store is not charged.

Figure 3:
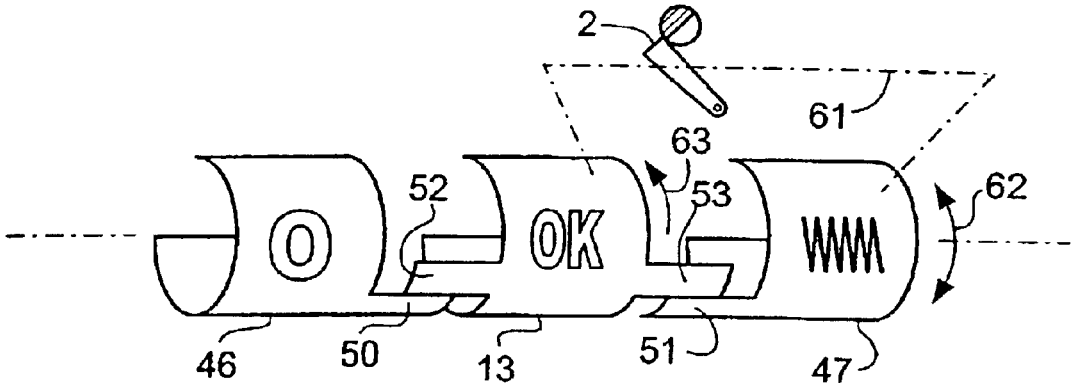
Figure 4:
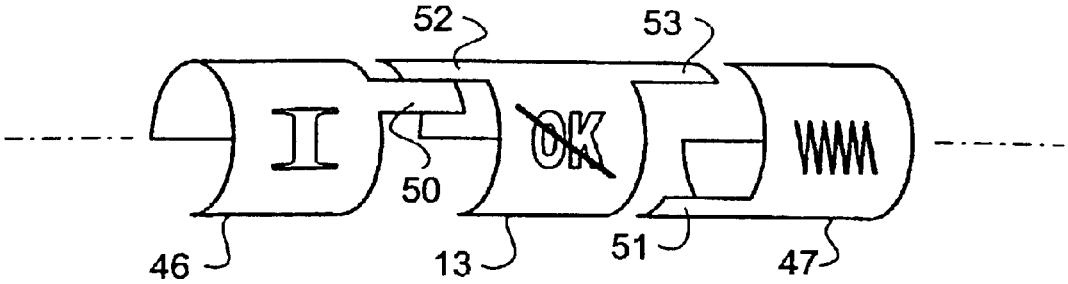

Let us firstly consider FIG. 3, which indicates the ready for closing state. In this case there appear next to one another in windows on the operator console 16 (FIG. 1) on the left the symbol "0" for the "switching contacts open" state, in the center the "OK" indication for existing closing readiness and on the right the known symbol of a spring for the "energy store tensioned" state, Indicated in FIG. 4 is the operating state in which, although the energy store is still tensioned and the indicating element 47 accordingly assumes the same position as in FIG. 2, the switching contacts 6 are closed. This has the consequence that the indicating element 46 shows the symbol "I" (ON) and therefore the indicating element 13 has been actuated by means of its driver 52 by the driver 50 of the indicating element 46 and indicates: "not ready for closing".

Figure 5:
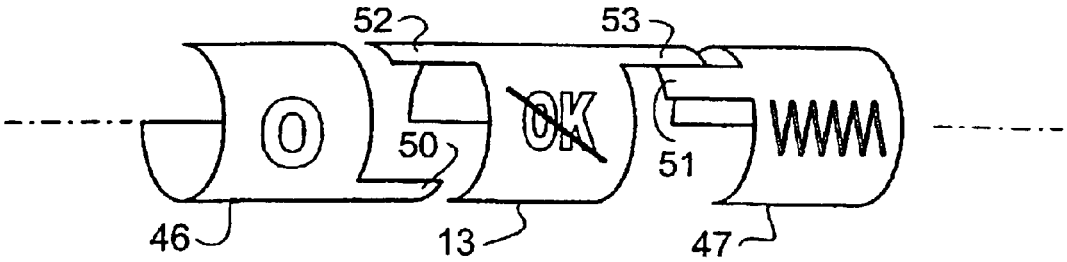

In the operating state according to FIG. 5, the indicating element 47 shows "energy store empty" (= symbol of relaxed spring) and the indicating element 46 shows "0" (= OFF switching position). In this case, the indicating element 13 shows "not ready for closing" on account of the interaction of the drivers 51 and 53.

Figure 6:
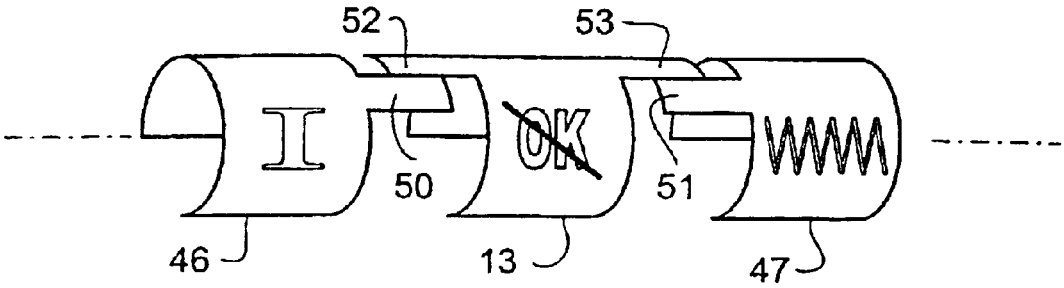

The indicating element 13 likewise indicates "not ready for closing" in the position according to FIG. 6, which represents the state in which the switching contacts 6 are closed (= ON switching position) and the energy store 1 is discharged (= "relaxed spring" symbol). To supply the device according to FIG. 1 with an opening command, there is provided an opening actuator 54, which acts in a suitable way on a pivotably mounted deflecting lever 55, which is pretensioned into its position of rest by a restoring spring 56. A slotted slide 57, connected in an articulated manner to the deflecting lever, reaches over a driver pin 58, mounted on the lever arm, in such a way that the opening half-shaft 10 can be rotated counterclockwise by the lever arm 26 and, as a result, the opening latching lever 11 can be released.

Represented in FIG. 2 is a modified exemplary embodiment in which direct actuation of the indicating elements 13 and 47 by the closing latching lever 2 is provided. For this purpose, the closing latching lever 2 is provided with a lug 60, which interacts with the driver 43. As can be seen, this only happens in that direction of movement which represents the ON state, in which the energy store 1 is discharged and, accordingly, there is no longer readiness for closing. As a result, the indicating element 13 for closing readiness is forcibly brought into the "not ready for closing" position. This is represented in FIG. 3 by a coupling linkage 61 and an arrow 62. The indicating element 47 (FIGS. 3–6) for the state of the energy store 1 is likewise forcibly actuated. This is likewise schematically illustrated in FIG. 3 by a double-headed arrow 63, which illustrates the actuation of the indicating element 47 by the closing latching lever 2 in both directions of movement.

A further modification with respect to the exemplary embodiment according to FIG. 2 is given in FIG. 3 with regard to the opening actuator 54. This acts on one lever arm of a two-armed auxiliary lever 64, which is pretensioned into a position of rest by a compression spring 65, which acts on the second lever arm of the auxiliary lever 64. In addition to the lever arms 25 and 26, the intermediate shaft 22 bears an opening lever arm 66, on which the auxiliary lever 64 acts when the opening actuator 54 is actuated. As can be seen, the auxiliary lever 64 and the opening lever arm 66 make it possible to actuate the intermediate shaft 22 by the opening actuator 54 in spite of a certain distance and different directions of action of the two elements. Under some circumstances it may be possible to omit the auxiliary lever 64, including its mounting and its restoring spring 65, if the opening actuator 54 can be made to act directly on the opening lever arm 66 of the auxiliary shaft 22.

Shown in FIGS. 1 and 2 as a further detail is an auxiliary switch 67, which can be actuated by the indicating element 13 for closing readiness. The auxiliary switch 67 can be used in a known way for electrically processing or indicating the closing readiness of a power circuit breaker equipped with the device described.

The entire device described, including the closing and opening actuators 36 and 54 and also the indicating elements 13, 46 and 47, can be produced as an extremely space-saving and mechanically reliable assembly. This makes it easier for all power circuit breakers provided with an energy store to be equipped with a device according to an embodiment of the invention.

List of designations

1 energy store
2 closing latching lever
4 latching device
4 closing half-shaft
3 latching device
5 tension spring
6 switching contacts
7 latching device
10 opening half-shaft
11 opening latching lever
13 indicating element for closing readiness
12 tension spring
14 indicating surface
15 window
16 operator console
17 tension spring
20 extension arm
21 arrow
22 intermediate shaft
23, 25 lever arm
24 arrow
26 lever arm
27 coupling element
30 pivot bearing
31 tilting lever
32 pivot bearing of the tilting lever 31
33 working surface
34 lever arm
35 arrow for pivoting
36, S closing actuator
37 restoring spring
38 restoring spring
40 frame-like middle part
41, 42 frame legs
41 middle part
42 frame leg
43, 44 drivers
45 attachment
46 indicating element for the switching state (ON/OFF)
47 indicating element for state of the energy store 1
50 driver on the indicating element 46
51 driver on the indicating element 47
52, 53 driver on the indicating element 13
54 opening actuator
55 deflecting lever
56 restoring spring for deflecting lever 55
57 slotted slide
58 driver pin
60 lug on the on latching lever 2
61 coupling linkage for indicating element 47
62 arrow for actuation of the indicating element 13
63 double-headed arrow for actuation of the indicating element 47
64 auxiliary lever
65 restoring spring for auxiliary lever 63
66 opening lever arm on the intermediate shaft 22
67 auxiliary switch on the indicating element 13
M1, M2 parameters
M1, M2, S actuating magnet The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for controlling the closing of a power circuit breaker according to at least one operational parameter, the power circuit breaker including switching contacts, an energy store for transferring the switching contacts from an opening position into a closing position, a latching device for maintaining a tensioned state of the energy store and at least one closing actuator for releasing the latching device and enabling the energy store, the device for controlling the closing comprising:

a coupling element, arranged in a path of force transfer from the closing actuator to the latching device, movable into an active position and an inactive position, an operational parameter causing the coupling element to be transferred into the inactive position, in which the force transfer from the closing actuator to the latching device is interrupted; and an indicating element, dependent on the coupling element and movable between only two positions respectively corresponding to exactly two states, to visually present the two states of "ready for closing" and "not ready for closing", wherein the indicating element for closing readiness moveable in response to an operational parameter, and wherein the indicating element and the coupling element are in mutual engagement for transferring the coupling element into its inactive position when the indicating element assumes the "not ready for closing" position.

2. The device as claimed in claim 1, wherein the indicating element for closing readiness is movable about a pivot axis and wherein the coupling element, which is designed as a lever, is displaceable in its longitudinal direction by the closing actuator and includes a frame-like middle part, reaches over a fixed guiding surface with a clearance and is able to be transferred by two drivers of the indicating element for closing readiness into at least one of the active position and the inactive position.

3. The device as claimed in claim 2, wherein the fixed guiding surface is formed by an attachment which is arranged concentrically in relation to the pivot axis of the indicating element and against which one frame leg of the middle part of the coupling element bears in its active position, and wherein the drivers of the indicating element for closing readiness, reach over the other frame leg of the middle part.

4. The device as claimed in claim 2, wherein an indicating element representing the state of the energy store and a further indicating element, representing the position of the switching contacts, are arranged to be movable about the pivot axis of the indicating element for closing readiness, and wherein each indicating element includes a driver for driving the indicating element for closing readiness.

5. The device as claimed in claim 4, wherein the closing latching lever bears a lug for direct forcible actuation of the indicating element for the state of the energy store in both positions and for actuation of the indicating element for closing readiness only in the "not ready for closing" direction.

6. The device as claimed in claim 5, wherein the indicating element for closing readiness is arranged centrally between the indicating elements for the switching position and for the state of the energy store.

7. The device as claimed in claim 1, wherein parameters based on the state of actuating magnets are adapted to be supplied to an intermediate shaft, including a first lever arm, interacting with the indicating element for closing readiness, and a second lever arm, interacting with a latching device controlling the opening of the power circuit breaker.

8. The device as claimed in claim 7, wherein the intermediate shaft bears, as a third lever arm, an opening lever arm, actuateable by an opening actuator.

9. The device as claimed in claim 3, wherein an indicating element representing the state of the energy store and a further indicating element, representing the position of the switching contacts, are arranged to be movable about the pivot axis of the indicating element for closing readiness, and wherein each indicating element includes a driver for driving the indicating element for closing readiness.

10. The device as claimed in claim 9, wherein the closing latching lever bears a lug for direct forcible actuation of the indicating element for the state of the energy store in both positions and for actuation of the indicating element for closing readiness only in the "not ready for closing" direction.

11. The device as claimed in claim 10, wherein the indicating element for closing readiness is arranged centrally between the indicating elements for the switching position and for the state of the energy store.

12. The device as claimed in claim 2, wherein parameters based on the state of actuating magnets are adapted to be supplied to an intermediate shaft, including a first lever arm, interacting with the indicating element for closing readiness, and a second lever arm, interacting with a latching device controlling the opening of the power circuit breaker.

13. The device as claimed in claim 2, wherein the intermediate shaft bears, as a third lever arm, an opening lever arm, actuateable by an opening actuator.

14. The device as claimed in claim 3, wherein parameters based on the state of actuating magnets are adapted to be supplied to an intermediate shaft, including a first lever arm, interacting with the indicating element for closing readiness, and a second lever arm, interacting with a latching device controlling the opening of the power circuit breaker.

15. The device as claimed in claim 3, wherein the intermediate shaft bears, as a third lever arm, an opening lever arm, actuateable by an opening actuator.

16. The device as claimed in claim 4, wherein parameters based on the state of actuating magnets are adapted to be supplied to an intermediate shaft, including a first lever arm, interacting with the indicating element for closing readiness, and a second lever arm, interacting with a latching device controlling the opening of the power circuit breaker.

17. The device as claimed in claim 4, wherein the intermediate shaft bears, as a third lever arm, an opening lever arm, actuateable by an opening actuator.

18. A device for indicating operational states of a circuit breaker, comprising:

a coupling element, movable into an active position and an inactive position, at least one operational parameter of the circuit breaker causing the coupling element to be transferred into the inactive position, in which the force transfer from the closing actuator to the latching device is interrupted; and an indicating element, dependent on the coupling element, movable between only a first closing position and a second non-closing position to visually present states of closing readiness of contacts of the circuit breaker, wherein the indicating element is transferable by an operational parameter from a first closing position into a second non-closing position, and wherein the indicating element and the coupling element are in mutual engagement for transferring the coupling element into its inactive position when the indicating element assumes the second non-closing position.

19. The device of claim 18, wherein the indicating element additionally displays at least one of a state of the contacts and a state of an energy store of the circuit breaker.

20. A device for indicating operational states of a circuit breaker, comprising:

a coupling element, adapted to be movable into an active position and an inactive position, at least one operational parameter of the circuit breaker causing the coupling element to be transferred into the inactive position, in which the force transfer from the closing actuator to the latching device is interrupted; and an indicating element, dependent on the coupling element, adapted to be movable and to visually present states of closing readiness of contacts of the circuit breaker, wherein the indicating element can be acted on directly by an operational parameter and is able to be transferred by an operational parameter from a first closing position into a second non-closing position, and wherein the indicating element and the coupling element are in mutual engagement for transferring the coupling element into its inactive position when the indicating element assumes the second non-closing position, wherein the indicating element is movable about a pivot axis and wherein the coupling element, which is designed as a lever, is displaceable in its longitudinal direction by the closing actuator and includes a frame-like middle part, reaches over a fixed guiding surface with a clearance, and is able to be transferred by at least one driver of the indicating element into at least one of the active position and the inactive position.

21. The device as claimed in claim 20, wherein the fixed guiding surface is formed by an attachment which is arranged concentrically in relation to the pivot axis of the indicating element and against which one frame leg of the middle part of the coupling element bears in its active position, and wherein the at least one driver of the indicating element, reaches over the other frame leg of the middle part.

22. The device as claimed in claim 20, wherein an indicating element representing the state of an energy store of the circuit breaker and a further indicating element, representing the position of the switching contacts, are arranged to be movable about the pivot axis of the indicating element, and wherein each indicating element includes a driver for driving the indicating element.

23. The device as claimed in claim 22, wherein the closing latching lever bears a lug for direct forcible actuation of the indicating element for the state of the energy store in both positions and for actuation of the indicating element for closing readiness only in the non-closing direction.

24. The device as claimed in claim 23, wherein the indicating element for closing readiness is arranged centrally between the indicating elements for the switching position and for the state of the energy store.

25. A device for indicating operational states of a circuit breaker, comprising:

a coupling element, adapted to be movable into an active position and an inactive position, at least one operational parameter of the circuit breaker causing the coupling element to be transferred into the inactive position, in which the force transfer from the closing actuator to the latching device is interrupted; and an indicating element, dependent on the coupling element, adapted to be movable and to visually present states of closing readiness of contacts of the circuit breaker, wherein the indicating element can be acted on directly by an operational parameter and is able to be transferred by an operational parameter from a first closing position into a second non-closing position, and wherein the indicating element and the coupling element are in mutual engagement for transferring the coupling element into its inactive position when the indicating element assumes the second non-closing position, wherein at least one parameter based on the state of actuating magnets are adapted to be supplied to an intermediate shaft, including a first lever arm, interacting with the indicating element, and a second lever arm, interacting with a latching device controlling the opening of the circuit breaker.

26. The device as claimed in claim 25, wherein the intermediate shaft bears, as a third lever arm, an opening lever arm, actuateable by an opening actuator.

27. The device as claimed in claim 18, wherein the circuit breaker includes switching contacts, an energy store for transferring the switching contacts from an opening position into a closing position, a latching device for maintaining a tensioned state of the energy store and at least one closing actuator for releasing the latching device and enabling the energy store.

28. The device as claimed in claim 18, wherein the indicating element is designed such that it can be acted on directly by an operational parameter of the circuit breaker and is able to be transferred by an operational parameter, counter to the action of a restoring force.

* * * * *